United States Patent [19]

Buzby et al.

[11] Patent Number: 4,985,120

[45] Date of Patent: Jan. 15, 1991

[54] METHOD FOR CONTROLLING PITCH DEPOSITS IN PULP AND PAPERMAKING PROCESSES WITH ORGANOTITANIUM (IV) COMPOUND

[75] Inventors: John H. Buzby, Willow Grove; Robert D. Evans, Warminster, both of Pa.

[73] Assignee: Quaker Chemical Corporation, Conshohocken, Pa.

[21] Appl. No.: 568,918

[22] Filed: Aug. 17, 1990

[51] Int. Cl.[5] ..... D21H 21/02; D21C 9/08

[52] U.S. Cl. ..... 162/199; 162/158; 162/181.2; 162/DIG. 4

[58] Field of Search ..... 162/199, DIG. 4, 158, 162/181.1

[56] References Cited

U.S. PATENT DOCUMENTS 3,058,936 10/1962 Leclerq et al. ..... 427/387

4,950,361 8/1990 Bender et al. ..... 162/199

*Primary Examiner*—Karen M. Hastings

*Attorney, Agent, or Firm*—Panitch Schwarze Jacobs & Nadel

[57] ABSTRACT

The deposition of pitch on the machinery used in pulping and papermaking processes and in the final paper produced in the papermaking process is prevented by adding an effective amount of a water-soluble organotitanium compound to the aqueous system of a pulping and/or papermaking process to prevent the deposition of the pitch on the machinery and in the final paper. The addition of an effective amount of a water-soluble organotitanium compound to the aqueous system of pulping and papermaking processes also removes pitch deposits from the machinery used in the pulping and papermaking processes.

19 Claims, No Drawings

METHOD FOR CONTROLLING PITCH DEPOSITS IN PULP AND PAPERMAKING PROCESSES WITH ORGANOTITANIUM (IV) COMPOUND

BACKGROUND OF THE INVENTION

This invention relates to a method for using water-soluble organotitanium(IV) compounds to control pitch deposition in pulping and papermaking processes. One aspect of this invention pertains to a method for preventing the deposition of pitch on machinery used in pulping and papermaking processes. Another aspect of this invention pertains to a method of preventing the formation of visible pitch particles in the final paper of a papermaking process. Yet another aspect of this invention pertains to a method for removing pitch deposits from machinery used in pulping and papermaking processes.

The problems caused by the build-up of pitch on pulping and papermaking machinery and in the final paper costs the pulp and paper industry more than 30 million dollars a year in lost production. Pitch is generally considered to be a resin based deposit of widely varying composition originating in the extractive fraction of wood. The extractive fraction of wood is one of the four principal components of wood. The other three are cellulose, lignin and hemicellulose. The extractive fraction is defined as a complex mixture of substances which are soluble in cold water, alcohol, benzene, ether and acetone. The extractive fraction, Which makes up from about 3% to 10% of the weight of wood, contains such components as low molecular weight carbohydrates, terpenes, aromatic and aliphatic acids, alcohols, tannins, color substances, proteins, phlobaphens, lignins, alkaloids and soluble lignins. Pitch is a major problem in pulp and papermaking because it (1) agglomerates and occludes other matter to form visible "dirt" in the final paper, (2) plates out and collects on machinery used in pulping and papermaking process such as screens, filters, refining equipment, pulp washers, and the paper machine, and (3) reduces pulp brightness and brightness stability.

The composition and amount of pitch deposited on pulping and papermaking machinery and in the final paper varies with the time of the year the trees are harvested, the type of wood and the type of the pulping process. For example, wood pulped from trees cut in the early spring and fall causes more pitch problems than wood from trees cut at other times during the year. Pitch deposited in softwood Kraft mills tends to have a relatively larger abietic acid to fatty acid ester ratio than pitch found in hardwood Kraft mills. Pitch deposit problems are somewhat more severe in sulfite mills. The sulfite pulping process removes only about one half of the resins and fatty acid esters, thus leaving a considerable portion of these materials encapsulated within the cellulose fibers. However, these encapsulated materials are released by the shearing forces of the refining process and thus pitch deposits are more prevalent in the stock preparation area and on the paper machine. Pitch problems can be quite bothersome in mechanical pulp mills, including groundwood, thermomechanical, chemical thermomechanical and semi-chemical pulping processes, particularly those that utilize softwoods. This is because there is little chemical degradation of the fatty acid esters and resin esters. Therefore, those materials are not washed out and tend to remain dispersed in the aqueous system of the pulping process.

The presence of calcium carbonate in the pulping process exacerbates the problem of pitch deposition on pulping and papermaking machinery. Crystallized calcium carbonate can provide nucleation sites for precipitated metal soaps, thereby producing hydrophobic particles which coalesce with other particles to form a pitch deposit.

There have been many attempts over the years to eliminate pitch problems by employing pitch control agents in the pulping and/or papermaking processes. The most common methods involve the use of alum, talc, anionic pitch-control agents such as polynaphthalene sulfonates or modified lignosulfonates, cationic pitch control agents such as polyquaternary ammonium polymers and nonionic surfactants. An example of the use of polyquaternary ammonium polymers as pitch control agents can be found in U.S. Pat. No. 2,582,461. The patent discloses the use of water soluble dicyandiamideformaldehyde condensates to prevent pitch deposition on machinery used in pulping and papermaking processes. Examples of attempts to control pitch with other types of compounds or processes are found in U.S. Pat. Nos. 3,812,055, 3,895,164, 3,896,046, 3,992,249 and 4,313,790. None of the above methods or compositions is completely effective in preventing pitch from depositing on machinery used in the pulping and papermaking processes. None of the above methods or compositions is completely effective in preventing pitch from depositing in the final paper produced in the pulping and papermaking processes. None of the above methods or compositions is effective at all in removing pitch deposits from machinery used in the pulping and papermaking processes during the operation of these processes. Pitch deposits are normally removed from the machinery used in the pulping and papermaking processes during shut down periods when the machinery is not in actual operation.

Recently, the use of water soluble zirconium salts to control pitch deposition and remove existing deposits has been reported (U.S. Pat. No. 4,950,361). This patent discloses a method of removing pitch deposits from machinery used in the pulping and papermaking processes while the machinery is in operation. The method disclosed in the patent also prevents pitch deposition on the machinery and in the final paper product.

Organotitanium chemicals have been used by the paper industry since the late 1950s, principally for use in crosslinking organopolysiloxanes used in rendering paper and cardboard surfaces more hydrophobic, thereby improving ink acceptance. Examples of such use can be found in U.S. Pat. No. 3,058,936 and Finland Patent No. 175,340. Cellulose treated with triethanolamine titanate has been reported to exhibit a considerably higher wet strength than that from untitanated pulp. The titanic acid resulting from aqueous solutions of triethanolamine titanate was reported to be the active compound for obtaining improved wet strength and ink acceptance properties with paper. (*Anorg. Alg. Chem.*, 403, 337 (1974)).

SUMMARY OF THE INVENTION

In accordance with the present invention, there is provided a method for controlling pitch present in pulping and papermaking processes. The method comprises formulating a pitch control agent consisting essentially of a water-soluble organotitanium(IV) compound and adding the pitch control agent to a water stream that comes into contact with cellulose pulp fibers in the pulping and papermaking processes in an amount sufficient to reduce or remove the deposition of the pitch on machinery used in the pulping and papermaking processes and to reduce the deposition of the pitch in paper produced in the papermaking process, wherein the pitch is a naturally occurring resin-based deposit originating in an extractive fraction of wood used in the pulping and papermaking processes.

DETAILED DESCRIPTION OF THE PREFERRED EMBODIMENTS

The invention provides a method of controlling pitch present in pulping and papermaking processes. As used herein, the term "controlling pitch" or equivalent terms means the prevention, reduction or removal of pitch depositions on or from machinery used in the pulping and papermaking processes and the prevention or reduction of pitch deposition in the final paper produced thereby. The pitch control agent used in controlling pitch, namely, a water-soluble organotitanium(IV) compound, may be used in varying amounts, depending on the type of control desired, the type of pitch involved, the amount of pitch on the machinery or the paper, the type of pulping or papermaking process involved, and other factors well known to those skilled in the art, based on the present disclosure.

The compound of the method of the invention is an organotitanium complex, also referred to as an organotitanium coordination complex. In a preferred embodiment of the invention, the titanium atom has four bonding or complexing sites, and the water-soluble organotitanium(IV) complex (hereinafter referred to as Compound I) has the following structure:

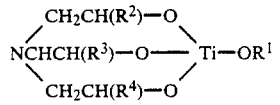

I where $R^1$ is selected from the group consisting of alkyl of 3 to 8 carbons, phenyl, aralkyl of 7 to 10 carbons, cyclohexylmethyl, 3-cyclohexyl-1-propyl, 2-(2-pyridyl)ethyl, 2-piperidinoethyl, $NH_2CH_2CH_2$—, $(CH_3)_2NCH_2CH_2$—, $CH_3OCH_2CH_2OCH_2CH_2$—and $CH_3(CH_2)_3OCH_2CH_2OCH_2CH_2$—; and $R^2$, $R^3$ and $R^4$ are independently selected from the group consisting of H— and $CH_3$—.

The presently preferred compounds within the structure of Compound I are compounds wherein $R^1$ is selected from the group consisting of n-alkyl of 4 to 8 carbons, $CH_3(CH_3)CH$—, $CH_3(CH_3)CHCH_2$—, $CH_3(CH_3)CH(CH_3)CH$—, $CH_3(CH_3)CHCH_2CH_2$—, $CH_3CH_2(CH_3)CHCH_2$—, $CH_3CH_2(CH_3)_2CCH_2$—, $CH_3CH_2CH_2CH_2(CH_3)CHCH_2$—; and $R^2$, $R^3$ and $R^4$ are independently selected from the group consisting of H— and $CH_3$—.

The presently most preferred compound corresponding to Compound I is titanium hexoxide tris(2,2'2''—nitrilo)isopropoxide, where $R^1$ is $C_6H_{13}$— and each of $R^2$, $R^3$ and $R^4$ is $CH_3$—.

Organotitanium complexes within the structure of Compound I are commercially available, such as the compound titanium isopropoxide tris(2,2'2''-nitrilo)ethoxide which is readily available from E. I. duPont de Nemours & Co., Inc., as Tyzor TE TM. Moreover, for organotitanium complexes within the structure of Compound I which are not presently readily available commercially, a chemist of ordinary skill in the art could readily prepare such compounds without undue experimentation in view of the present disclosure. In general, to prepare complexes having the structure of Compound I, the following general preparative technique may be used.

Titanium tetraisopropoxide and one equivalent of an alcohol are added to a round bottom flask. The mixture is distilled under nitrogen at a temperature not exceeding 130.C. After one equivalent of isopropanol has been removed, the reaction is cooled to room temperature. A trialkanolamine chelate (one equivalent per Ti) is added and the mixture distilled under nitrogen at a temperature not exceeding 130° C. until approximately 2.4 equivalents of isopropanol are removed. The resulting product has the general structure of Compound I.

In another preferred embodiment of the invention, the titanium atom has six bonding or complexing sites, and the water-soluble organotitanium(IV) complex (hereinafter referred to as Compound II) has the following general molecular structure:

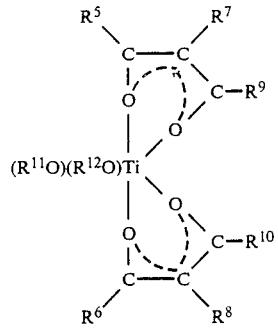

II where $R^5$, $R^6$, $R^9$ and $R^{10}$ are independently selected from the group consisting of alkyl of 1 to 2 carbons, alkoxy of 1 to 2 carbons and benzyloxy;

$R^7$ and are independently selected from the group consisting of hydrogen and alkyl of 1 to 2 carbons; and $R^{11}$ and $R^{12}$ are independently selected from the group consisting of alkyl of 2 to 8 carbons.

Organotitanium complexes with the general molecular structure of Compound II may be the cis isomer of structure III or the trans isomer of structure IV as follows:

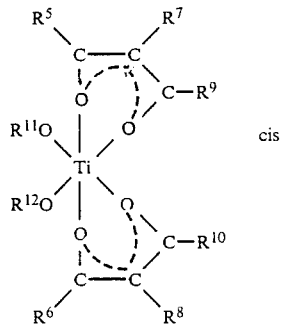

III cis

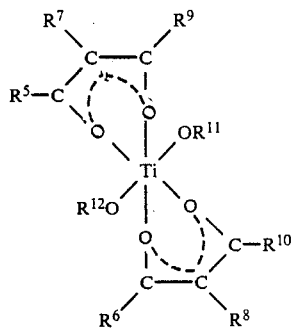

IV trans

In general, the cis isomer of structure III is preferred over the trans isomer of structure IV in the method of the present invention, in that the cis isomer is more soluble than the trans isomer. Nevertheless, both the cis and trans isomers are effective in controlling pitch in pulping and papermaking processes according to the present invention.

The presently preferred embodiments of organotitanium complexes within the structure of Compound II are compounds wherein $R^5$, $R^6$, $R^9$ and $R^{10}$ are independently selected from the group consisting of alkyl of 1 to 2 carbons;

$R^7$ and $R^8$ are selected from the group consisting of hydrogen and methyl; and $R^{11}$ and $R^{12}$ are independently selected from the group consisting of alkyl of 3 to 8 carbons.

The presently most preferred complex within the structure of Compound II is the cis isomer III, cis titanium diisoproproxide bis(2,4-pentanedionate), wherein $R^5$, $R^6$, $R^9$ and $R^{10}$ are $CH_3$—, $R^7$ and $R^8$ are hydrogen, and $R^{11}$ and $R^{12}$ are $CH_3(CH_3)CH$—, commercially available from Aldrich Chemical Company. When this compound is solubilized in water, it can convert to the trans isomer IV. Another example of an organotitanium complex within the general structure of Compound II is titanium diisopropoxide bis(ethyl-3-oxobutanoate), which is commercially available from E. I. duPont de Nemours & Co, Inc., as Tyzor DC TM. Moreover, for organotitanium complexes within the structure of Compound II which are not presently readily available commercially, a chemist of ordinary skill in the art could readily prepare such compounds without undue experimentation in view of the present disclosure. In general, to prepare complexes having the structure of Compound II, the following general preparative technique may be used.

Titanium tetraisopropoxide and two equivalents of an alcohol are added to a round bottom flask. The mixture is distilled under nitrogen at a temperature not exceeding 140° C. After two equivalents of isopropanol have been removed, the reaction is cooled to room temperature. A beta-diketo chelate (2 equivalents per Ti) is added and the mixture distilled under nitrogen at a temperature not exceeding 140° C. until about 1.5 equivalents of isopropanol are removed. The resulting product has the general composition of Compound II.

The method of the invention can be used to control pitch deposition in any conventional pulping process including the Kraft, sulfite, mechanical, thermomechanical, chemical thermomechanical, semi-chemical, stone groundwood and chip groundwood processes. Since pitch can collect on any and all parts of the machinery used in the pulping and papermaking processes, the machinery used in the pulping and papermaking processes is defined as all surfaces that contact the aqueous system of the pulping or papermaking process including, but not restricted to, pipes, tanks, screens, meters, pumps, headboxes, foils, wires, felts, dryers, doctor blades, grinders, refiners and evaporators. Pitch can also deposit in the final paper of the papermaking process by itself or in combination with other matter to form visible pitch particles. Visible pitch particles are those particles that are apparent by visible examination of a sheet of paper using standard methods of detection. These methods include visual examination under UV light, after staining or dying the sheet with an appropriate stain or dye, and detection using image analysis.

The aqueous system of a pulping and/or papermaking process is defined as any water stream that comes in contact with cellulose pulp fibers in a pulping or papermaking process. This includes the water in digesters, blow tanks, washers, stock tanks, screens, bleaching equipment, evaporators, refiners, beaters, headboxes and wire pits. It is essential to the operation of the present invention that the water-soluble organotitanium(IV) compound enter into the aqueous system of a pulping or papermaking process in order to prevent the formation of or remove pitch deposits from machinery. On the other hand, it is not crucial to the practice of the present invention how the water-soluble organotitanium(IV) compound is introduced into the aqueous system of a pulping and/or papermaking process. Any method of introduction of the water-soluble organotitanium(IV) compound directly or indirectly into the aqueous system of the pulping and/or papermaking process can be used. For example, the water-soluble organotitanium(IV) compound may even be added directly to the wood cellulose fibers before they come in contact with the aqueous system of a pulping or papermaking process. This method includes spraying an aqueous solution of the water-soluble organotitanium(IV) compound directly onto wood chips prior to adding them to a digester in a chemical pulping operation.

The water-soluble organotitanium(IV) compound can also be added to the digester and any operation downstream of the digester in a pulping or chemical recovery operation including the blow tank, or the washing, screening, cleaning, thickening, bleaching or refining operations or liquor recovery system. The water-soluble organotitanium(IV) compound may also be added to the stock preparation system. The stock preparation system includes the high density chest, the stock blending chest, the refiners, the machine chest and the stuff box. The water-soluble organotitanium(IV) compound may also be added to the wet end of a paper machine. The wet end of a paper machine begins with the fan pump and ends at the point where the sheet exits from the press section to enter the drier section.

The amount of water-soluble organotitanium(IV) compound to be added to a pulping or papermaking process depends on the extent of pitch build-up already in the system, if any, the type of pulping or papermaking process, the type of wood from which the pulp originates, the presence of other contaminants, the particular organotitanium(IV) compound or blend selected, and other parameters associated with such processes. The amount of water-soluble organotitanium(IV) compound used in any aqueous pitch control agent formed according to the present invention may be determined readily by one of ordinary skill in the art without undue experimentation with reference to this disclosure. Some routine trial and error experimentation may be necessary to adjust the particular amounts to optimize the amounts and technique of addition of the organotitanium(IV) compound or water-soluble pitch control agent containing such compound.

In general, about 0.0003 pounds to about 0.5 pounds of organotitanium(IV) compound in an aqueous and/or alcoholic solution per ton of dry pulp, calculated on the basis of the amount of titanium present in the compound, should be used in the method of the present invention. It is presently preferred to use about 0.0005 pounds to about 0.07 pounds of organotitanium(IV) compound per ton of dry pulp, again calculated on the basis of the amount of titanium present. More of the water-soluble organotitanium(IV) compound may be used if desired, but excess amounts may not be economical.

In a preferred embodiment of the present invention, a water-soluble organotitanium(IV) compound is introduced into the aqueous system of a papermaking process by formulating a pitch control agent from an aqueous solution of a water-soluble organotitanium(IV) compound, and then adding the pitch control agent into the blender immediately before the machine chest of a Fourdrinier paper machine. About 0.0042 to about 0.85 pound of Compound I added per ton of dry pulp should be suitable to control pitch according to the present invention. This is equivalent to about 0.0005 to about 0.229 pound of titanium per ton of dry pulp. If Compound II is to be used, about 0.0042 to about 0.85 pound of Compound II added per ton of dry pulp should be suitable to control pitch according to the present invention. This is equivalent to about 0.00035 to about 0.112 pound of titanium per ton of dry pulp.

In this embodiment, it is preferred that about 0.0042 to about 0.51 pound of Compound I, equivalent to about 0.0005 to about 0.137 pound of titanium be added per ton of dry pulp. If Compound II is to be used, it is preferred that about 0.0042 to about 0.51 pound of Compound II, equivalent to about 0.0035 to about 0.0672 pound of titanium be added per ton of dry pulp.

It is more preferred in this embodiment to use about 0.0042 to about 0.51 pound of compound I, where $R^1$ is $C_6H_{13}$— and $R^2$, $R^3$ and $R^4$ are $CH_3$—, namely, titanium hexoxide tris(2,2'2''-nitrilo)isopropoxide, equivalent to about 0.0006 to about 0.071 pound of titanium per ton of dry pulp. It is more preferred in this embodiment to use about 0.0042 to about 0.51 pound of Compound II, where $R^5$, $R^6$, $R^9$ and $R^{10}$ are $CH_3$—, $R^7$ and $R^8$ are H— and $R^{11}$ and $R^{12}$ are $CH_3(CH_3)CH$—, namely, titanium diisopropoxide bis(2,4-pentanedionate), equivalent to about 0.0005 to about 0.0672 pound of titanium, added per ton of dry pulp.

In another preferred embodiment of the present invention, a water-soluble organotitanium(IV) compound can be introduced into the aqueous system of a pulping process by adding an aqueous and/or alcoholic solution of a water-soluble organotitanium(IV) compound into the water line of a last stage washer of a multi-stage rotary vacuum pulp washer line. About 0.0084 to about 0.85 pound of Compound I, equivalent to about 0.001 to about 0.229 pound of titanium, per ton of dry pulp should be suitable to control pitch according to the present invention. About 0.0084 to about 0.85 pound of Compound II, equivalent to about 0.007 to about 0.112 pound of titanium, per ton of dry pulp should be suitable to control pitch according to the present invention.

Preferably in this embodiment, about 0.0084 to about 0.51 pound of Compound I, equivalent to about 0.001 to about 0.137 pound of titanium, are added per ton of dry pulp or about 0.0084 to about 0.51 pound of Compound II, equivalent to about 0.007 to about 0.0672 pounds of titanium, are added per ton of dry pulp.

It is presently more preferred in this embodiment that about 0.0084 to about 0.51 pound of Compound I, where $R^1$ is $C_6H_{13}$— and $R^2$, $R^3$ and $R^4$ are $CH_3$—, equivalent to about 0.0012 to about 0.071 pound of titanium, is added per ton of dry pulp or about 0.0084 to about 0.51 pound of Compound II, where $R^5$ $R^6$, $R^9$ and $R^{10}$ are $CH_3$—, $R^7$ and $R^8$ are H— and $R^{11}$ and $R^{12}$ are $CH_3(CH_3)CH$—, equivalent to about 0.001 to about 0.0672 pound of titanium, is added per ton of dry pulp.

The invention will now be described in more detail with reference to the following specific, non-limiting examples.

Examples 1 and 2 illustrate the preparation of organotitanium complexes within the ambit of Compounds I and II, respectively, employed in the method of the present invention.

EXAMPLE 1

Preparation of Compound I

The compound titanium hexoxide tris (2, 2', 2''-nitrilo)isopropoxide, where $R^1$ is $C_6H_{13}$— and $R^2$, $R^3$ and $R^4$ are $CH_3$—, was prepared in the following manner. Titanium tetraisopropoxide (25.8 g, 0.0907 mol) and 1-hexanol (9.3 g, 0.091 mol) were added to a 100 mL round bottom flask fitted with a magnetic stirrer, distillation head and source of nitrogen fitted with a Firestone valve. Distillation was carried out under nitrogen at 120°-140° C. until one equivalent of isopropanol was collected. The mixture was cooled to room temperature and then, with cooling, triisopropanolamine (17.36 g, 0.0908 mol) was added. This mixture was distilled under nitrogen at 120°-140° C. until collection of isopropanol ceased (82% conversion). The mixture was cooled to room temperature to yield the product as a light yellow, slightly turbid oil (32.64 g, 78.7% yield).

EXAMPLE 2

Preparation of Compound II

The compound cis titanium dihexoxide bis(2,4-pentanedionate), where $R^5$, $R^6$, $R^9$ and $R^{10}$ are $CH_3$—, $R^7$ and $R^8$ are H— and $R^{11}$ and $R^{12}$ are $CH_3(CH_2)_4CH_2$—, was prepared in the following manner. Titanium tetraisopropoxide (26.5 g, 0.0932 mol) and 1-hexanol (19.11 g, 0.187 mol) were added to a 100 mL round bottom flask fitted with a magnetic stirrer, distillation head and source of nitrogen fitted with a Firestone valve. Distillation was carried out under nitrogen at 120°-140 C. until two equivalents of isopropanol were collected. The mixture was cooled to room temperature and then, with cooling, 2,4-pentanedione (18.71 g, 0.1869 mol) was added. This mixture was distilled under nitrogen at 130°-135° C. until collection of isopropanol ceased. The mixture was cooled to room temperature to yield the product as a light yellow liquid.

EXAMPLE 3

Preparation of Synthetic Pitch

To about 1000 g of tap water were added about 80 g of Unitol DT-25 TM (a tall oil containing 72% fatty acids, 26% rosin acids, and 2% unsaponifiables, Union Camp), about 6 g of Indulin C TM (sodium salt of Kraft pine lignin, Westvaco Chemicals), 22 g of rosin acid (primarily abietic and dihydroabietic acid) and about 28 g of 50% aqueous sodium hydroxide solution. The dispersion was heated with stirring to about 130° F. until homogeneous, resulting in a synthetic pitch product. This mixture closely approximates the chemical composition, physical and chemical properties of natural pitch as determined by laboratory experience with the synthetic pitch and field experience with natural pitch.

EXAMPLE 4

Deposition Reduction Testing of Organotitanium Compounds

To a 3000 mL stainless steel beaker equipped with a hot plate and anchor stirrer, 2500 mL tap water was added and heated to 165.F with stirring. Four low density polyethylene centrifuge tubes, 50 mL each, 8.5 cm in length, were washed with acetone, dried and weighed to 0.1 mg.

The tubes were lowered into the 165.F water and 100 mL of the stock synthetic pitch solution, prepared as in Example 3, were slowly added. After stirring for 2 minutes, 0.14 g of each of the organotitanium(IV) compound listed in Table 1, was added and the pH lowered to 4 using 98% sulfuric acid. The mixtures were stirred at 165° F. for 1.5 hours while maintaining the liquid level constant. The tubes were removed, air dried for 16 hours and weighed to 0.1 mg.

Ammonium zirconium carbonate, a compound previously determined to be very effective in controlling pitch in pulping and papermaking processes, was added in the same amount and subjected to the same treatment as the organotitanium(IV) compounds of the present invention, for comparison of efficacy in pitch reduction.

The efficiency of the additive was measured by the amount of pitch deposited on the tube versus a control having no additive. Table 1 shows the deposition results obtained with representative organotitanium(IV) compounds.

TABLE 1

PERCENT REDUCTION OF SYNTHETIC PITCH DEPOSITS

| Sample Number | Compound Type* | Additive | % Reduction in Pitch Deposition** |
|---|---|---|---|
| Control | | None | 0 |
| 1. | I | Titanium isopropoxide tris (2,2',2''-nitrilo) ethoxide | 47.6 |
| 2. | I | Titanium hexoxide tris (2,2',2''-nitrilo) isopropoxide | 64.6 |
| 3. | I | Titanium octoxide tris (2,2',2''-nitrilo) ethoxide | 57.0 |
| 4. | I | Titanium phenoxide tris (2,2',2''-nitrilo) ethoxide | 34.5 |
| 5. | I | Titanium N,N-dimethyl-2-ethoxide tris (2,2'2''-nitrilo)ethoxide | 47.0 |
| 6. | III | Titanium diisopropoxide bis (2,4-pentanedionate) | 46.5 |
| 7. | III | Titanium diisopropoxide bis (2,4-pentanedionate) | 59.3 |
| 8. | III | Titanium dihexoxide bis (ethyl-3-oxobutanoate) | 51.6 |
| 9. | III | Titanium dihexoxide bis (2,4-pentanedionate) | 63.8 |
| 10. | IV | Titanium dihexoxide bis (2,4-pentanedionate) | 58.3 |
| 11. | *** | Ammonium zirconium carbonate | 33.0 |

*I = Compound I structure
III = Compound II cis structure III
IV = Compound II trans structure IV
**% Reduction in Pitch Deposition =

$$\frac{\text{Weight of deposit without additive} - \text{wt. of deposit with additive}}{\text{Weight of deposit without additive}} \times 100$$

***For Comparison purposes; not a compound under the present invention.

The results clearly indicate that the compounds of the method of the invention are useful and very effective in reducing pitch deposition. All of the compounds of the method of the present invention tested reduced pitch deposition by 34.5% or greater. The percent reduction ranged from 34.5% to 64.6% for the Compound I embodiments and from 46.5% to 63.8% for the Compound II embodiments. The compounds of the invention were generally more effective in reducing pitch deposition than a prior art compound, ammonium zirconium carbonate, which produced a 33% pitch reduction. The increase in pitch reduction according to the present invention is very significant.

The present invention may be embodied in other specific forms without departing from the spirit or essential attributes thereof and, accordingly, reference should be made to the appended claims, rather than to the foregoing specification as indicating the scope of the invention.

We claim:

1. A method for controlling pitch present in pulping and papermaking processes comprising:

(a) formulating a pitch control agent consisting essentially of a water-soluble organotitanium(IV) compound; and (b) adding the pitch control agent to a water stream that comes into contact with cellulose pulp fibers in the pulping and papermaking processes in an amount sufficient to reduce or remove the deposition of the pitch on machinery used in the pulping and papermaking processes and to reduce the deposition of the pitch in paper produced in the papermaking processes, wherein the pitch is a naturally occurring resin-based deposit originating in an extractive fraction of wood used in the pulping and papermaking processes.

2. The method of claim 1 wherein the water-soluble organotitanium(IV) compound is selected from the group consisting of Compounds I and II having the respective structures:

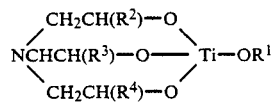

I where $R^1$ is selected from the group consisting of alkyl of 3 to 8 carbons, phenyl, aralkyl of 7 to 10 carbons, cyclohexylmethyl, 3-cyclohexyl-1-propyl, 2-(2-pyridyl)ethyl, 2-piperidinoethyl, $NH_2CH_2CH_2$—, $(CH_3)_2NCH_2CH_2$—, $CH_3OCH_2CH_2OCH_2CH_2$— and $CH_3(CH_2)_3OCH_2CH_2OCH_2CH_2$—; and $R^2$, $R^3$ and $R^4$ are independently selected from the group consisting of H— and $CH_3$—; and

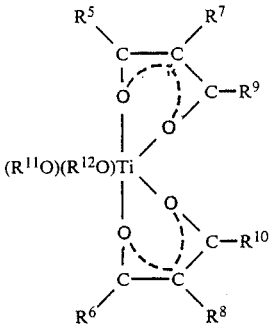

II where $R^5$, $R^6$, $R^9$ and $R^{10}$ are independently selected from the group consisting of alkyl of 1 to 2 carbons, alkoxy of 1 to 2 carbons and benzyloxy;

$R^7$ and $R^8$ are independently selected from the group consisting of hydrogen and alkyl of 1 to 2 carbons; and $R^{11}$ and $R^{12}$ are independently selected from the group consisting of alkyl of 2 to 8 carbons.

3. The method of claim 2 wherein the organotitanium(IV) compound is Compound I, wherein $R^1$ is selected from the group consisting of n-alkyl of 4 to 8 carbons, $CH_3(CH_3)CH$—, $CH_3(CH_3)CHCH_2$—, $CH_3(CH_3)CH(CH_3)CH$—, $CH_3(CH_3CHCH_2CH_2$—, $CH_3CH_2(CH_3)CHCH_2$—, $CH_3CH_2(CH_3)_2CCH_2$—, $CH_3CH_2CH_2CH_2(CH_3)CHCH_2$—; and $R^2$, $R^3$ and $R^4$ are independently selected from the group consisting of H— and $CH_3$—.

4. The method of claim 3 wherein $R^1$ is $C_6H_{13}$— and each of $R^2$, $R^3$ and $R^4$ is $CH_3$—.

5. The method of claim 2 wherein the organotitanium(IV) compound is Compound II having a structure selected from the group consisting of cis isomer of structure III and trans isomer of structure IV as follows:

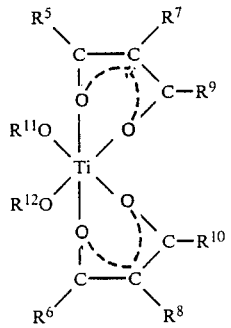

III cis

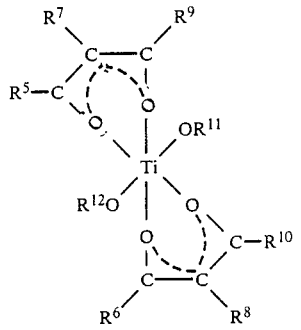

IV trans

6. The method of claim 5 wherein Compound II is the cis isomer of structure III and wherein $R^5$, $R^6$, $R^9$ and $R^{10}$ are independently selected from the group consisting of alkyl of 1 to 2 carbons;

$R^7$ and $R^8$ are selected from the group consisting of hydrogen and methyl; and $R^{11}$ and $R^{12}$ are independently selected from the group consisting of alkyl of 3 to 8 carbons.

7. The method of claim 6 wherein $R^5$, $R^6$, $R^9$ and $R^{10}$ are $CH_3$—, $R^7$ and $R^8$ are hydrogen, and $R^{11}$ and $R^{12}$ are $CH_3(CH_3(CH$—.

8. The method of claim 5 wherein Compound II is the trans isomer of structure IV and wherein $R^5$, $R^6$, $R^9$ and $R^{10}$ are independently selected from the group consisting of alkyl of 1 to 2 carbons;

$R^7$ and $R^8$ are selected from the group consisting of hydrogen and methyl; and $R^{11}$ and $R^{12}$ are independently selected from the group consisting of alkyl of 3 to 8 carbons.

9. The method of claim 8 wherein $R^5$, $R^6$, $R^9$ and $R^{10}$ are $CH_3$—, $R^7$ and $R^8$ are hydrogen, and $R^{11}$ and $R^{12}$ are $CH_3(CH_3)CH$—.

10. The method of claim 1 wherein step (b) comprises adding the pitch control agent in a pulling process or chemical recovery operation associated therewith in a location at or downstream of a digester.

11. The method of claim 1 wherein step (b) comprises adding the pitch control agent to a stock preparation system of a pulping process comprising at least one of a high density chest, a stock blending chest, a refiner, a machine chest or a stuff box.

12. The method of claim 1 wherein step (b) comprises adding the pitch control agent to a wet end of a paper machine used in the papermaking process.

13. The method of claim 1 wherein step (b) comprises adding the pitch control agent to a blender immediately before a machine chest of a Fourdrinier paper machine used in the papermaking process.

14. The method of claim 1 wherein step (b) comprises adding the pitch control agent into a water line of a last stage washer of a multi-stage rotary vacuum pulp washer used in the pulping process.

15. The method of claim 1 wherein step (b) comprises adding the pitch control agent in an amount of about 0.0003 to about 0.5 pound per ton of dry pulp, calculated on the basis of the amount of titanium present.

16. The method of claim 1 wherein step (b) comprises adding the pitch control agent in an amount of about 0.0005 to about 0.07 pound per ton of dry pulp, calculated on the basis of the amount of titanium present.

17. The method of claim 15 wherein the pitch control agent is selected from the group consisting of titanium hexoxide tris (2,2'2''-nitrilo)isopropoxide and titanium diisopropoxide bis(2,4-pentanedionate).

18. The method of claim 16 wherein the pitch control agent is selected from the group consisting of titanium hexoxide tris (2,2'2''-nitrilo)isopropoxide and titanium diisopropoxide bis (2,4-pentanedionate).

19. The method of claim 1 wherein the pulping and papermaking processes are selected from the group consisting of Kraft, sulfite, mechanical, thermomechanical, chemical thermomechanical, semi-chemical, stone groundwood and chip groundwood processes.

* * * * *

UNITED STATES PATENT AND TRADEMARK OFFICE

CERTIFICATE OF CORRECTION

PATENT NO. : 4,985,120

DATED : January 15, 1991

INVENTOR(S) : John H. Buzby and Robert D. Evans

It is certified that error appears in the above-identified patent and that said Letters Patent is hereby corrected as shown below:

Column 2, line 19, "U.S. Patent No. 2,582,461" should read --U.S. Patent No. 3,582,461--.

Column 2, lines 53-54, "Finland Patent No. 175,340" should read --French Patent No. 1,175,340--.

Column 2, lines 60-61, "(Anorg. Alg. Chem., 403, 337 (1974))" should read --(Z. Anorg. Allg. Chem., 403, 337 (1974))--.

Column 3, lines 36-40, amend the formula as follows:

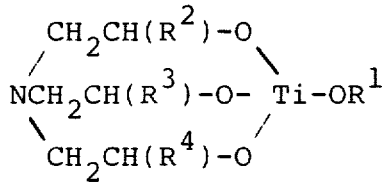

I

UNITED STATES PATENT AND TRADEMARK OFFICE

CERTIFICATE OF CORRECTION

PATENT NO. : 4,985,120

DATED : January 15, 1991

INVENTOR(S) : John H. Buzby and Robert D. Evans

It is certified that error appears in the above-identified patent and that said Letters Patent is hereby corrected as shown below:

Column 4, line 45, after "and", insert --$R^8$--.

In the Claims:

Claim 2, amend the formula as follows:

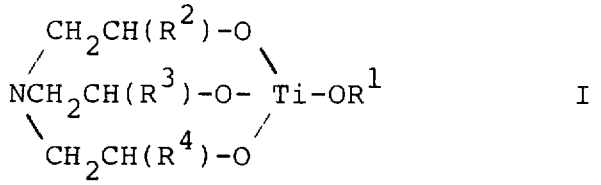

I

Claim 10, "pulling" should read --pulping--.

Signed and Sealed this

Twenty-third Day of June, 1992

*Attest:*

DOUGLAS B. COMER

*Attesting Officer*

*Acting Commissioner of Patents and Trademarks*